US012055365B2

(12) United States Patent
Crispin

(10) Patent No.: US 12,055,365 B2
(45) Date of Patent: Aug. 6, 2024

(54) LOCKING ADJUSTMENT DEVICE

(71) Applicant: Leupold & Stevens, Inc., Beaverton, OR (US)

(72) Inventor: Quint Crispin, Beaverton, OR (US)

(73) Assignee: LEUPOLD & STEVENS, INC., Beaverton, OR (US)

( * ) Notice: Subject to any disclaimer, the term of this patent is extended or adjusted under 35 U.S.C. 154(b) by 0 days.

(21) Appl. No.: 17/651,789

(22) Filed: Feb. 18, 2022

(65) Prior Publication Data

US 2022/0170717 A1 Jun. 2, 2022

Related U.S. Application Data

(63) Continuation of application No. 16/807,051, filed on Mar. 2, 2020, now Pat. No. 11,255,636, which is a (Continued)

(51) Int. Cl.
*F41G 1/16* (2006.01)
*F41G 1/38* (2006.01)

(52) U.S. Cl.
CPC ..... *F41G 1/16* (2013.01); *F41G 1/38* (2013.01)

(58) Field of Classification Search
CPC ..... F41G 1/16; F41G 1/18; F41G 1/38; F41G 1/387; G02B 7/16; G02B 23/14; G02B 23/16; G02B 23/2476

(Continued)

(56) References Cited

U.S. PATENT DOCUMENTS 680,442 A 8/1901 Schmitt
1,344,973 A 6/1920 Bader (Continued)

FOREIGN PATENT DOCUMENTS

CN 2752794 Y 1/2006
DE 2148967 B2 4/1973

(Continued)

OTHER PUBLICATIONS

Army Concept Team in Vietnam, Use of Night Vision Devices by US army Units in Vietnam (U), Activ Project No. ACG-25F Final Report—Night Vision Devices, dated Nov. 30, 1966, 66 pages.

(Continued)

*Primary Examiner* — Joshua E Freeman
*Assistant Examiner* — Benjamin S Gomberg
(74) *Attorney, Agent, or Firm* — Schwabe, Williamson & Wyatt, P.C.

(57) ABSTRACT

A locking adjustment device for adjusting a setting of an aimed optical device, such as a riflescope, locks at a home or baseline position to provide expedient feedback regarding an adjustment position of the adjustable setting. The device includes a knob mountable for rotation about a rotational axis when the adjustment device is installed on the aimed optical device, where the knob is rotatable about the rotational axis. The device further includes a catch that automatically locks the knob in the home or baseline position and prevents further rotation of the knob until the catch is released. A lock-release mechanism carried by the knob is manually actuatable to disengage the catch and allow the knob to be manually rotated away from the locked position.

34 Claims, 6 Drawing Sheets

Related U.S. Application Data continuation of application No. 14/923,158, filed on Oct. 26, 2015, now Pat. No. 10,578,399, which is a continuation of application No. 13/343,656, filed on Jan. 4, 2012, now Pat. No. 9,170,068.

(58) Field of Classification Search
USPC ..... 74/529
See application file for complete search history.

(56) References Cited

U.S. PATENT DOCUMENTS 2,143,167 A 1/1939 Pechar
2,165,796 A 7/1939 Humeston
2,208,913 A 7/1940 Unertl
2,229,637 A 1/1941 Burton
2,336,107 A 12/1943 Litschert
2,452,592 A 11/1948 Meyer
2,583,042 A * 1/1952 Dayton ..... F41G 1/473 42/122
2,585,933 A 2/1952 Harvey
2,682,707 A 7/1954 Dahlberg
2,704,466 A 3/1955 Way
2,833,158 A 5/1958 Damon
2,913,826 A 11/1959 Petty
3,037,287 A 6/1962 Glatz
3,058,391 A 10/1962 Leopold
3,161,716 A 12/1964 Burris
3,222,987 A 12/1965 Wrigglesworth
3,280,463 A 10/1966 Stadler
3,297,389 A 1/1967 Gibson
3,471,932 A 10/1969 Luning
3,662,618 A 5/1972 Kroll
3,707,204 A 12/1972 Dussardier
3,826,012 A 7/1974 Pachmayr
3,916,721 A 11/1975 Egger
3,990,155 A 11/1976 Akin, Jr.
3,999,442 A 12/1976 Decker
4,012,966 A 3/1977 Lieberman
4,026,397 A 5/1977 Raus
4,038,757 A 8/1977 Hicks
4,132,129 A 1/1979 Pratt
4,154,125 A 5/1979 Frank
4,200,355 A 4/1980 Williams, Jr.
4,201,096 A 5/1980 Morrison
4,240,201 A 12/1980 Sawby
4,247,161 A 1/1981 Unertl
4,300,525 A 11/1981 Delgado
4,347,758 A 9/1982 Geil
4,373,269 A 2/1983 Doliber
4,389,791 A 6/1983 Ackerman
4,408,842 A 10/1983 Gibson
4,457,076 A 7/1984 Heck
4,461,330 A 7/1984 Judkins
4,643,542 A 2/1987 Gibson
4,779,305 A * 10/1988 Gorsek ..... G05G 5/18 16/DIG. 30
4,818,086 A 4/1989 Moore
4,955,253 A 9/1990 Sakai
4,982,502 A 1/1991 Weyrauch
5,020,389 A 6/1991 Sigler
5,083,477 A 1/1992 Geil
5,121,653 A 6/1992 Sigler
5,152,187 A 10/1992 LaFemina
5,329,829 A 7/1994 Sell
5,363,559 A 11/1994 McCarty
5,433,010 A 7/1995 Bell
5,499,456 A 3/1996 Tomita
5,513,440 A * 5/1996 Murg ..... F41G 1/26 33/298
5,586,569 A 12/1996 Hanning
5,615,487 A 4/1997 Tomita
5,618,374 A 4/1997 Byerley
5,695,125 A 12/1997 Kumar
5,715,607 A 2/1998 Murg
5,745,287 A 4/1998 Sauter
5,771,595 A 6/1998 Bell
5,862,715 A 1/1999 Lemire
5,892,617 A 4/1999 Wallace
5,906,141 A 5/1999 Abdelmoula
5,930,934 A 8/1999 Fisher
6,005,711 A 12/1999 Mai
6,279,259 B1 8/2001 Otteman
6,351,907 B1 3/2002 Otteman
6,442,854 B1 9/2002 Liu
6,508,144 B1 1/2003 Vendetti
6,519,890 B1 2/2003 Otteman
6,588,125 B2 7/2003 Proctor, Sr.
6,643,970 B2 11/2003 Huber
6,691,447 B1 2/2004 Otteman
6,705,037 B2 3/2004 Van Kirk
6,721,095 B2 4/2004 Huber
6,772,550 B1 8/2004 Leatherwood
6,848,628 B2 2/2005 Walker
6,860,442 B2 3/2005 Datcuk, Jr.
6,862,832 B2 3/2005 Barrett
7,117,624 B2 10/2006 Kim
7,121,037 B2 10/2006 Penney
7,330,310 B2 2/2008 Hengst
7,612,952 B2 * 11/2009 Schafer ..... F41G 1/18 359/813
7,640,830 B2 1/2010 Bonis
8,006,429 B2 8/2011 Windauer
8,205,762 B2 6/2012 Carroll
8,270,104 B2 * 9/2012 Windauer ..... F41G 1/18 359/821
8,407,927 B2 4/2013 Huber
8,516,736 B2 8/2013 Windauer
8,806,798 B2 8/2014 Crispin
8,984,796 B2 3/2015 Thomas
9,170,068 B2 10/2015 Crispin
9,182,773 B2 11/2015 Campean
9,188,408 B2 11/2015 Huynh
9,292,034 B2 3/2016 Windauer
RE46,011 E 5/2016 Huber
9,435,609 B2 9/2016 Hamilton
9,665,120 B2 5/2017 Windauer
9,823,684 B2 11/2017 Finley
10,101,122 B2 10/2018 Davidson
10,132,593 B2 11/2018 White
10,190,848 B2 1/2019 VanBecelaere
10,190,849 B1 1/2019 Webber
10,302,394 B2 5/2019 Ding
10,309,749 B2 6/2019 Hamilton
10,337,831 B2 7/2019 Lin
10,578,399 B2 3/2020 Crispin
10,900,747 B2 1/2021 Kilic
11,255,636 B2 2/2022 Crispin
2003/0140545 A1 7/2003 Huber
2004/0088898 A1 5/2004 Barrett
2006/0254115 A1 11/2006 Thomas
2006/0268433 A1 11/2006 Thomas
2006/0278035 A1 12/2006 Casas
2007/0240356 A1 10/2007 Klepp
2008/0066364 A1 * 3/2008 Klepp ..... F41G 1/38 42/122
2008/0236018 A1 10/2008 Halverson
2009/0044660 A1 * 2/2009 Bonis ..... F41G 1/38 74/813 L
2009/0199452 A1 * 8/2009 Huber ..... F41G 1/38 42/125
2009/0205461 A1 * 8/2009 Windauer ..... F41G 1/40 74/553
2010/0175298 A1 * 7/2010 Thomas ..... F41G 1/18 42/122
2011/0061285 A1 3/2011 Hamilton
2011/0100152 A1 * 5/2011 Huynh ..... F41G 1/22 74/504
2012/0030988 A1 2/2012 Windauer
2016/0123704 A1 5/2016 Crispin
2017/0205195 A1 7/2017 Sheets, Jr.
2019/0072363 A1 3/2019 Kilic

(56) References Cited

U.S. PATENT DOCUMENTS

| | | | |
|---|---|---|---|
| 2019/0128642 | A1 | 5/2019 | Davis |
| 2020/0271415 | A1 | 8/2020 | Crispin |

FOREIGN PATENT DOCUMENTS

| | | | |
|---|---|---|---|
| DE | 29720737 | U1 | 3/1998 |
| DE | 29903989 | U1 | 7/1999 |
| DE | 20301749 | U1 | 6/2003 |
| DE | 10222528 | A1 | 12/2003 |
| DE | 202006003770 | U1 | 7/2006 |
| EP | 0271982 | A2 | 6/1988 |
| GB | 598306 | A | 2/1948 |
| GB | 708438 | A | 5/1954 |
| GB | 1102022 | A | 2/1968 |
| GB | 1214584 | A | 12/1970 |
| GB | 2213959 | B | 3/1989 |
| JP | 11-085290 | A | 3/1999 |
| JP | 2003-222499 | A | 8/2003 |
| JP | 2004-150699 | A | 5/2004 |
| WO | 2006/060490 | A2 | 6/2006 |
| WO | 2006/109587 | A2 | 10/2006 |
| WO | 2010/008810 | A2 | 1/2010 |
| WO | 2013/102869 | A1 | 7/2013 |
| WO | 2013/102872 | A1 | 7/2013 |

OTHER PUBLICATIONS

Article: Bayonet Mount, Answers.com Encyclodistionalmanacapedia, http://www.answers.com/topic/bayonet-mount, visited Sep. 28, 2006, 2 pages.

Canon, Inc., Digital Video Camcorder Instruction Manual for model LX2, 2004 (date of publication unknown), 10 pages.

Canon, Inc., Digital Video Camcorder Instruction Manual for model LX2, 2004 (date of publication unknown), pp. 1, 6, 7, 9-11, 32, 43, 55, 56 and 126.

International Search Report and Written Opinion, International Application No. PCT/US2013/020062, dated Apr. 25, 2013, 13 pages.

International Search Report and Written Opinion, International Patent Application No. PCT/US05/43336, dated Jul. 7, 2008, 4 pages.

Leupold & Stevens, Inc., Complaint for Patent Infringement, *Leupold & Stevens, Inc.* v. *Lightforce USA, Inc.*, Case No. 3:16-cv-1570-HZ (D. Or.), Aug. 2, 2016, 15 pages.

Leupold & Stevens, Inc., Declaration of David Byron in Support of Leopold's Response to Nightforce's Supplemental Claim Construction Brief, *Leopold & Stevens, Inc.* v. *Lightforce USA.*, Case No. 3:16-cv-01570-HZ (D. Or.) Mar. 17, 2021, 19 pages.

Leupold & Stevens, Inc., Plaintiff's Opening Claim Construction Brief [Redacted Public Version], *Leopold & Stevens, Inc.* v. *Lightforce USA, Inc.*, Case No. 3:16-cv-01570-HZ (D. Or.), Feb. 11, 2021, 41 pages.

Leupold & Stevens, Inc., Plaintiff's Response to Defendant's Supplemental Claim Construction Brief [Redacted Version], *Leopole & Stevens, Inc.* v. *Lightforce USA, Inc.*, Case No. 3:16-cv-01570-HZ (D. Or.), Mar. 18, 2021, 44 pages.

Leupold & Stevens, Inc., Supplemental Declaration of David Byron Regarding Claim Constructions, *Leopold & Stevens, Inc.* v. *Lightforce USA, Inc.*, Case No. 3:16-cv-01570-HZ (D. Or.), Feb. 11, 2021, 13 pages.

Lightforce USA, Inc., Answer to Plaintiff's Complaint and Defendant's Counterclaims, *Leopold & Stevens, Inc.* v. *Lightforce USA, Inc.*, Case No. 3:16-cv-1570-HZ (D. Or.), Dec. 6, 2016, 20 pages.

Lightforce USA, Inc., Declaration of Arie Pellikaan in Support of Nightforce's Supplemental Claim Construction Brief Pursuant to ECF No. 241, *Leopold & Stevens, Inc.* v. *Lightforce USA, Inc.*, Case No. 3:16-cv-01570-HZ (D. Or.), Feb. 11, 2021, 3 pages.

Lightforce USA, Inc., Declaration of Douglas P. DuFaux in Support of Nightforce's Supplemental Claim Construction Brief Pursuant to ECF No. 241, *Leopold & Stevens, Inc.* v. *Lightforce USA, Inc.*, Case No. 3:16-cv-01570-HZ (D. Or.), Feb. 11, 2021, 11 pages.

Lightforce USA, Inc., Defendant's Third Supplemental Rule 26(a)(2)C) Disclosure (Turret Knob Patents), *Leopold & Stevens, Inc.* v. *Lightforce USA, Inc.*, Case No. 3:16-cv-01570-HZ (D. Or.), Dec. 31, 2020, 21 pages.

Lightforce USA, Inc., Expert Report of Doublas P. DuFaux, *Leopold & Stevens, Inc.* v. *Lightforce USA, Inc.*, Case No. 3:16-cv-1570-HZ (D. Or.) Aug. 24, 2018, 91 pgaes.

Lightforce USA, Inc., Lightforce USA, Inc. Non-Infringement and Invalidity/Unenforceability Contentions (redacted), *Leopold & Stevens, Inc.* v. *Lightforce USA, Inc.*, Case No. 3:16-cv-1570-HZ (D. Or.), Mar. 15, 2017, 36 pages.

Lightforce USA, Inc., Lightforce USA, Inc.'s Supplemental Invalidity/Unenforceability Contentions for Counts I Through VIII; and Supplemental Non-Infringement Contentions for Counts I Through VIII, *Leopold & Stevens, Inc.* v. *Lightforce USA, Inc.*, Case No. 3:16-cv-01570-HZ (D. Or.), Mar. 5, 2018, 293 pages.

Lightforce USA, Inc., Nightforce's Response to Plaintiff's Opening Claim Construction Brief, *Leopold & Stevens, Inc.* v. *Lightforce USA, Inc.*, Case No. 3:16-cv-01570-HZ (D. Or.), Mar. 17, 2021, 21 pages.

Lightforce USA, Inc., Nightforce's Supplemental Claim Construction Brief Pursuant to ECF No. 241, *Leopold & Stevens, Inc.* v. *Lightforce USA, Inc.*, Case No. 3:16-cv-01570-HZ (D. Or.), Feb. 11, 2021, 40 pages.

United States District Court for the District of Oregon, Opinion and Order, *Leopold & Stevens, Inc.* v. *Lightforce USA, Inc.*, Case No. 3:16-cv-01570-HZ (D. Or.), Jan. 31, 2018, 30 pages.

United States District Court for the District of Oregon, Opinion and Order, *Leopold & Stevens, Inc.* v. *Lightforce USA, Inc.*, Case No. 3:16-cv-01570-HZ (D. Or.), Nov. 17, 2020, 63 pages.

* cited by examiner

LOCKING ADJUSTMENT DEVICE

RELATED APPLICATION DATA

This application is a continuation of and claims the benefit under 35 U.S.C. § 120 from U.S. patent application Ser. No. 16/807,051, filed Mar. 2, 2020 (now U.S. Pat. No. 11,255,636) and entitled "LOCKING ADJUSTMENT DEVICE," which is a continuation of and claims the benefit under 35 U.S.C. § 120 from U.S. patent application Ser. No. 14/923,158, filed Oct. 26, 2015 (now U.S. Pat. No. 10,578,399) and entitled "LOCKING ADJUSTMENT DEVICE," which is a continuation of and claims the benefit under 35 U.S.C. § 120 from U.S. patent application Ser. No. 13/343,656 filed Jan. 4, 2012 (now U.S. Pat. No. 9,170,068) and entitled "LOCKING ADJUSTMENT DEVICE," the disclosures of which are incorporated by reference herein in their entireties.

TECHNICAL FIELD

The field of the present disclosure relates generally to rotating adjustment mechanisms, and in particular, to locking adjustment knobs for actuating optical or electrical elements such as an elevation adjustment knob for a sighting device, such as a riflescope, a telescope, or other aimed optical devices.

BACKGROUND

Sighting devices such as riflescopes have long been used in conjunction with weapons and firearms, such as rifles, handguns, and crossbows, to allow a shooter to accurately aim at a selected target. Because bullet and arrow trajectory, wind conditions, and distance to the target can vary depending upon shooting conditions, quality sighting devices typically provide compensation for variations in these conditions by allowing a shooter to make incremental adjustments to the optical characteristics or the aiming of the sighting device relative to the weapon surface on which it is mounted. These adjustments are known as elevation and windage adjustments, and are typically accomplished by lateral movement of an adjusting member, such as a reticle located within the riflescope, as shown in U.S. Pat. No. 3,058,391 of Leupold, or movement of one or more lenses within a housing of the riflescope, as shown in U.S. Pat. Nos. 3,297,389 and 4,408,842 of Gibson, and U.S. Pat. No. 7,827,723 of Zaderey et al.

The shooter typically makes such adjustments using rotatable adjustment knobs to actuate the adjustable member of the sighting device. Rotatable knobs may also be used to adjust other features of riflescopes, binoculars, spotting scopes, or other suitable optical devices, such as parallax, focus, illumination brightness, or other suitable features. Although the rotatable knobs are described in relation to use with sighting devices, rotatable knobs may be used to adjust an adjustable portion of other devices, and may include volume control knobs, channel selection knobs, radio station selection knobs, and other suitable knobs.

Automatically locking devices with rotatable adjustment knobs are known. For example, U.S. patent application Ser. No. 12/938,981 filed Nov. 3, 2010 and published as US 2011/0100152 A1, which is incorporated herein by reference describes an automatically locking adjustment device. The locking device includes a rotatable knob with two buttons on opposite sides of the knob that must be squeezed together to unlock the knob for rotation and thereby enable a desired adjustment. When the buttons are released, the knob is immediately locked at its current rotational position. One drawback of this adjustment device is its relative complexity and attendant expense of manufacture. The squeezing pressure required to unlock the knob for rotation may also make it more difficult to effect multiple fine rotation adjustments in the course of an aiming operation, when inadvertent rotation of the knob is less of a concern.

The present inventor has, thus, recognized a need for an improved locking adjustment mechanism for preventing inadvertent adjustment of an optical or electrical setting of a device.

SUMMARY

An apparatus is disclosed for a locking adjustment device that may be used to change an adjustable setting of a riflescope or other device. The locking adjustment device automatically locks in a home position or baseline position to provide expedient feedback regarding an adjustment position of the adjustable setting. According to one embodiment, the locking adjustment device includes a knob mountable for rotation about an axis when the adjustment device is installed on the riflescope or other aimed optical device. The device further includes a catch that automatically locks the knob in the home or baseline position and prevents further rotation of the knob until the catch is released. In some embodiments, the catch may include a first member fixedly attached to the aimed optical device and a second member supported by the knob for rotation therewith, wherein the catch automatically retains the knob in the home position when the first and second members are aligned. The device further includes a lock-release mechanism carried by the knob, the lock-release mechanism being manually actuatable to disengage the catch and allow the knob to be manually rotated away from the locked position.

In another embodiment, the device may include a fixed stop different from the home position, wherein the stop interferes with the second member of the catch to block the knob and prevent the knob from being rotated beyond the stop.

In some embodiments, the device may further include an indicator unit carried by the knob and visible on a surface of the knob, and a biasing element operatively associated with the indicator unit to urge movement of the indicator unit. The indicator unit may be at a first position when the knob is in the home position and at a second position when the knob is in the adjustment position.

Additional aspects and advantages will be apparent from the following detailed description of preferred embodiments, which proceeds with reference to the accompanying drawings.

DETAILED DESCRIPTION OF PREFERRED EMBODIMENTS

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
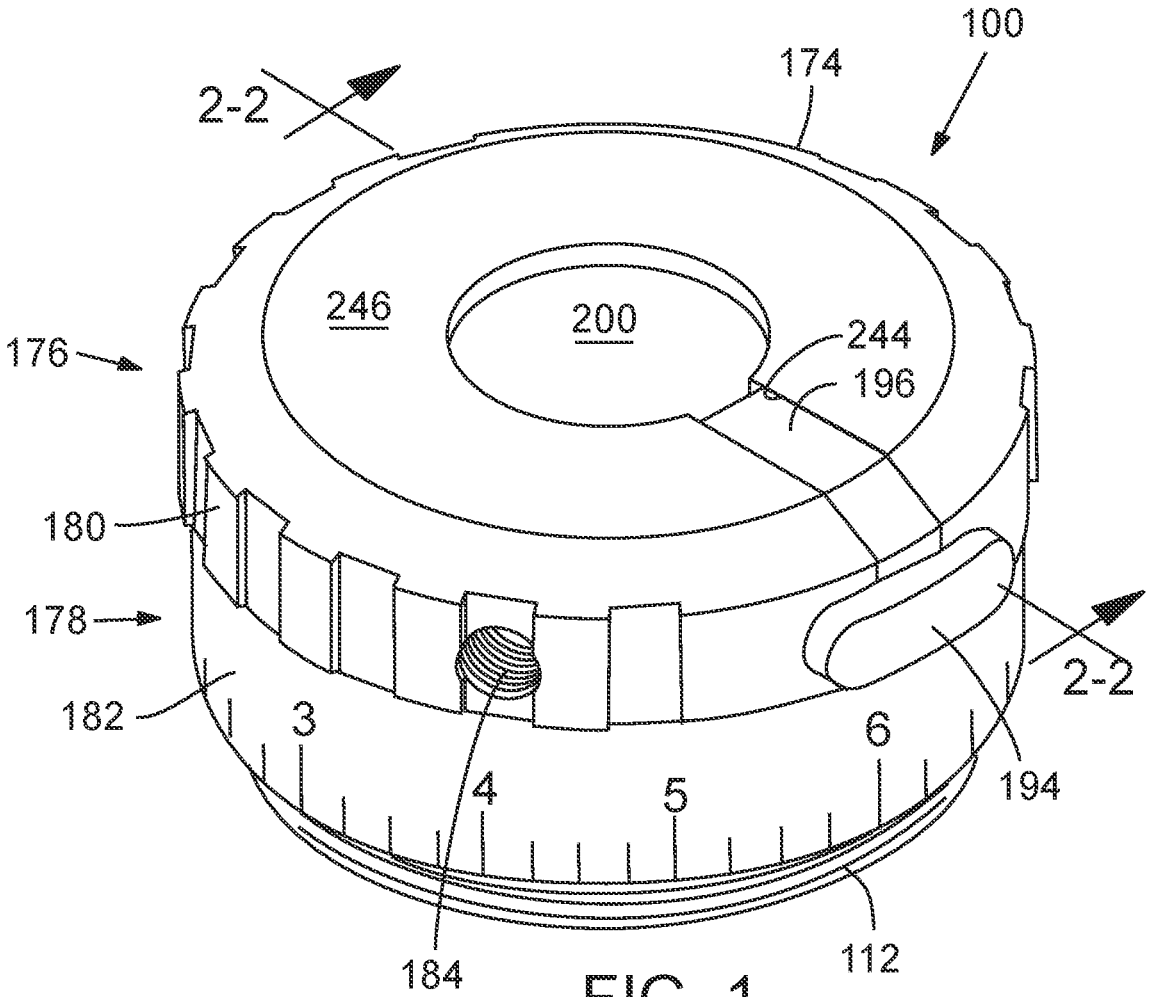
FIG. 1 is a perspective view of a locking adjustment device, according to one embodiment.
Figure 2:
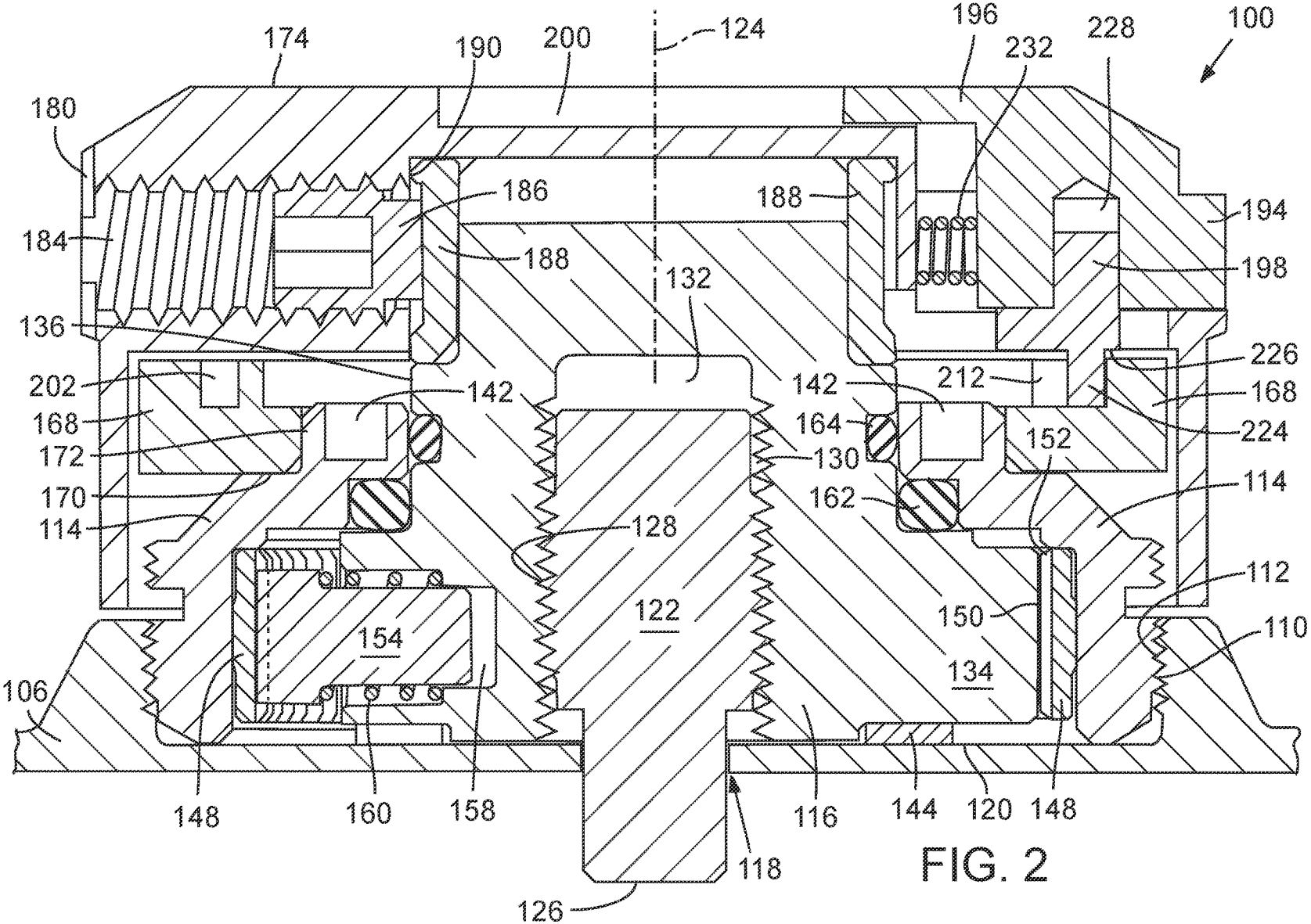
FIG. 2 is a cross-sectional view of the locking adjustment device of FIG. 1 taken along line 2-2.

FIGS. 1-5, 6A, 6B, and 6C illustrate various detailed views of a locking adjustment device 100 that may be used to change an adjustable setting of a riflescope 138 or other aiming device and that automatically locks in a baseline or "home" position to provide expedient feedback regarding an adjustment position of the adjustable setting, according to one embodiment. With reference to FIGS. 1-2, locking adjustment device 100 includes a knob 174, where adjustments may be made by rotation of knob 174 about a rotational axis 124 extending outwardly from riflescope 138. Knob 174 includes a depressible button 194 operatively coupled to an indicator unit 196 (resting in a slot 244) and an internal guide tab 198 (FIG. 2). When locking adjustment device 100 is in a locked position, button 194, indicator unit 196, and guide tab 198 may be at a first position, where button 194 protrudes outwardly from knob 174 and indicator unit 196 is radially extended in relation to axis 124. Knob 174 is unlocked by depressing button 194, thereby transitioning button 194 and indicator unit 196 to a second position that indicates knob 174 is unlocked and manually rotatable about axis 124.

The following describes further detailed aspects of this and other embodiments of the locking adjustment device 100. In the following description of the figures and any example embodiments, reference may be made to using the locking adjustment device disclosed herein to actuate an adjustable member of a sighting device on a weapon or firearm, such as for making elevation and windage adjustments. It should be understood that any such references merely refer to one prospective use for such a locking adjustment device and should not be considered as limiting. Other uses for locking adjustment devices with the characteristics and features described herein are possible, including use in other mechanical or electrical devices for making adjustments, such as to a volume, channel, or station setting, or other suitable mechanical, electrical, optical, or electronic adjustments. Still other uses not specifically described herein may be possible. In addition, although the following description is made with reference to a single locking adjustment device, the riflescope or other device may include multiple such locking adjustment devices.

Figure 3:
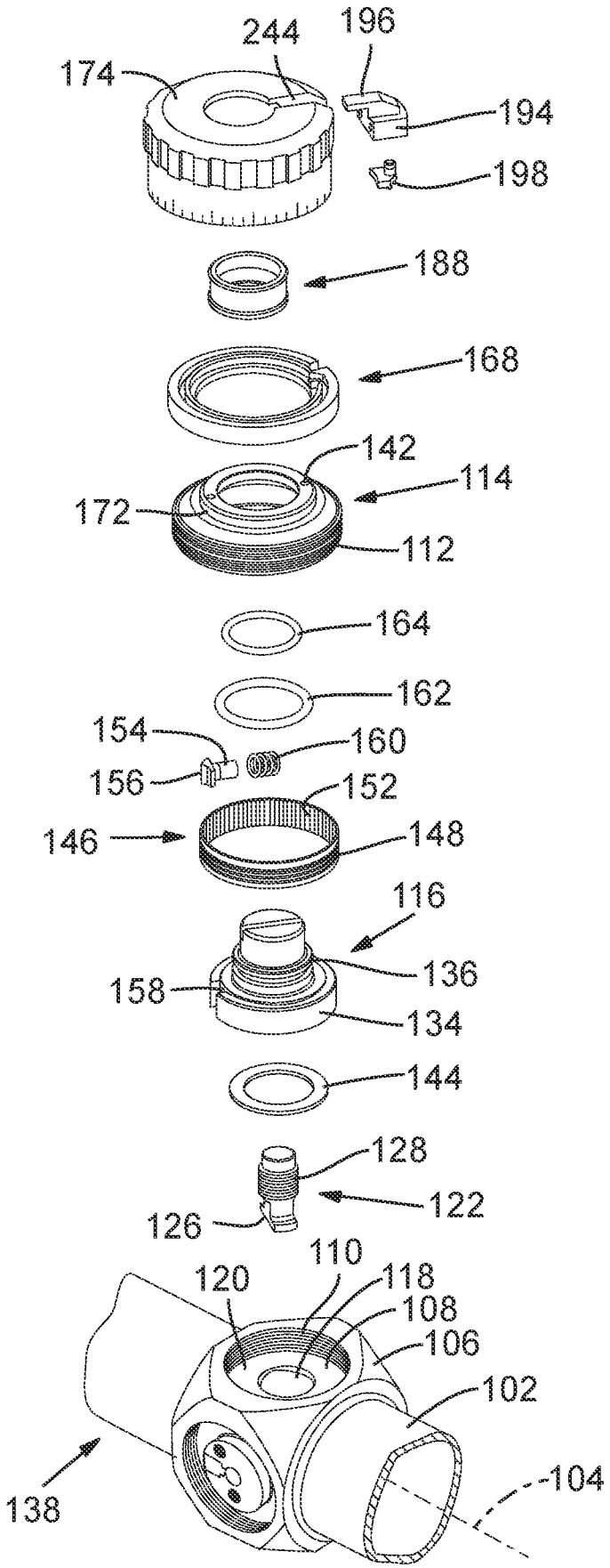
FIG. 3 is an exploded view of the locking adjustment device of FIG. 1.

With reference to FIGS. 1-3, locking adjustment device 100 is mounted to a main tube 102 of riflescope 138. Within main tube 102, at least one adjustable element, such as a reticle, lens assembly, or other optical or electrical elements, may be movably mounted in a substantially perpendicular orientation relative to a longitudinal tube axis 104. Main tube 102 further includes a seat 106, which has a bore 108 sized to receive locking adjustment device 100. Bore 108 may include threads 110 formed on an interior wall or shoulder of bore 108 that may mate with corresponding threads 112 on a retaining ring 114 or another structure of locking adjustment device 100, such as a spindle 116, to secure locking adjustment device 100 to main tube 102 when locking adjustment device 100 is installed. Bore 108 further includes a slot or aperture 118 formed at a base 120 and sized to receive a threaded plunger 122 via an end 126 of plunger 122. Plunger 122 includes threads 128 sized to mesh with interior threads 130 on an interior bore 132 of spindle 116 so that plunger 122 may be threadably coupled to spindle 116.

Plunger 122 extends into main tube 102 and is constrained from rotating about axis 124 so that rotation of spindle 116 (into which plunger 122 is threaded) is translated into linear motion of plunger 122 along axis 124, thereby adjusting a position of the adjustable element within main tube 102. This arrangement is simply one configuration for an adjustment core and it should be understood that there are many other possible configurations for main tube 102 and for the accompanying structures described above, such as the riflescopes described in U.S. Pat. Nos. 6,279,259, 6,351,907, 6,519,890, and 6,691,447. In other embodiments, the adjustment core may have different mechanical arrangements for effecting a mechanical, electrical, and/or optical adjustment.

Spindle 116 includes a lower base portion 134 and an upper neck portion 136, which preferably is smaller in diameter than lower base portion 134. Retaining ring 114 surrounds spindle 116 and retains spindle 116 against seat 106 of the riflescope 138. Retaining ring 114 includes exterior threads 112 sized to mesh with threads 110 on bore 108. Thus, spindle 116 is captured against main tube 102 and allowed to rotate about axis 124, but is constrained from traveling along axis 124 by retaining ring 114, which is threaded into bore 108 of main tube 102. Retaining ring 114 includes a pair of blind bores 142 sized to fit a spanner wrench for threading and tightening retaining ring 114 onto spindle 116 or into bore 108, or both.

In some embodiments, exterior threads 112 may be omitted and retaining ring 114 may instead be affixed to bore 108 such as by a press-fit or a weld, or by another fastening mechanism, such as a bayonet mount. In the embodiment illustrated, a washer 144 is sandwiched between lower base portion 134 of spindle 116 and base 120 of seat 106. Washer 144 may be made from any suitable wear-resistant material, such as nylon, polytetrafluorethylene (PTFE) polymer (e.g., Teflon®), or other suitable material.

Locking adjustment device 100 may include a click mechanism 146 to provide tactile and/or audible feedback to the user when knob 174 of locking adjustment device 100 is rotated. Click mechanism 146 includes a click ring 148 interposed between a shoulder 150 of the lower base portion 134 of spindle 116 and retaining ring 114. Click ring 148 includes a grooved surface 152 facing spindle 116. Grooved surface 152 includes regularly spaced apart features, which preferably include splines or a series of evenly spaced vertical grooves or ridges. Other engagement features may include a series of detents, indentations, apertures, or other suitable features. Click mechanism 146 further includes a click pin 154 with a ramped surface 156 configured to engage the regularly spaced apart features of grooved surface 152. Click pin 154 is housed within a bore 158 in spindle 116 that has an open end facing grooved surface 152. A spring 160, or other biasing element, urges click pin 154 to extend outwardly from within bore 158 and engage grooved surface 152 of click ring 148. In operation, rotational movement of knob 174 about axis 124 causes click pin 154 to move out of contact with one groove and into a neighboring groove, thereby producing a click that is either audible, tactile, or both. Each click may coincide with an adjustment amount to alert the user about the extent of an adjustment being made. Click mechanism 146 continues clicking as long as knob 174 is rotated.

In some embodiments, locking adjustment device 100 may include sealing devices and other features to minimize entry of foreign materials, such as dust, dirt, or other contaminants, to help prevent rust, wear, or other damage to the components of locking adjustment device 100. The seals may be hermetic seals and the interior of riflescope 138 may be filled with a dry gas, such as nitrogen or argon, to help prevent fogging that may otherwise be caused by condensation of moisture vapor on surfaces of lenses and other optical elements within riflescope 138. For example, in some embodiments, locking adjustment device 100 may include a pair of contaminant seals 162, 164 sandwiched between retaining ring 114 and spindle 116 to seal any openings or gaps between the two components. Contaminant seals 162, 164 are preferably o-rings formed of rubber or another elastomeric material, but may be formed by any other suitable sealing material, such as plastic, nylon, or PTFE polymers (e.g., Teflon®).

Locking adjustment device 100 further includes a guide ring 168 attached along a stepped portion 170 of an upper necked portion 172 of retaining ring 114. Guide ring 168 is preferably press fit around retaining ring 114 such that it rests flush against stepped portion 170 and upper necked portion 172. In some embodiments, guide ring 168 may be welded, threaded, or adhered by an adhesive substance to retaining ring 114. In other embodiments, guide ring 168 may be integrated with or formed in retaining ring 114 or main tube 102. Particular aspects and features of guide ring 168 are described below in further detail with reference to FIGS. 4 and 5.

Locking adjustment device 100 includes knob 174 mountable over guide ring 168 and spindle 116 for rotation about axis 124 when locking adjustment device 100 is installed on riflescope 138. Knob 174 includes a retaining cap 176 and a dial 178. Retaining cap 176 includes a cylindrical gripping surface 180 that may be notched, fluted, knurled, or otherwise textured to provide a surface for the user to grip when manually rotating knob 174. Dial 178 may be supplied with a fine scale composed of parallel longitudinal indicia 182 spaced apart around the circumference of dial 178 to facilitate fine adjustments. Retaining cap 176 and dial 178 may be fabricated as a single unitary part or may be formed from two separate components that are coupled together, such as via mating threads.

Knob 174 includes a threaded bore 184 sized to receive a threaded set screw 186. It should be understood that any number of bores, with a corresponding number of set screws, may be provided on knob 174. Set screw 186 rigidly couples knob 174 to a collar 188 that is press-fit onto upper neck portion 136 of spindle 116 so that knob 174 and spindle 116 rotate together as a unit. In other embodiments (not shown), collar 188 may be omitted and knob 174 may be directly coupled to spindle 116 by set screws 186 or otherwise. A tool, such as a hex key, can be used to tighten set screw 186 such that set screw 186 bears against collar 188. Similarly, the tool can be used to loosen set screw 186 so that knob 174 and/or dial 178 can be rotated relative to spindle 116 about axis 124 or removed and replaced with a different knob 174, if desired. In other embodiments (not shown), knob 174 is coupled or releasably coupled to spindle 116 in a manner other than by set screws 186. The combination of collar 188 and set screws 186, in conjunction with a flanged portion 190 on collar 188, help prevent knob 174 from lifting upward in a direction along axis 124.

Knob 174 may carry a button 194 and an indicator unit 196 for rotation therewith. Button 194 is operably associated with a guide tab 198 and manually depressible to urge guide tab 198 out of a locked position and thereby allow knob 174 to be manually rotated about axis 124 away from the locked position. The cross-sectional view in FIG. 2 illustrates the position of guide tab 198 after knob 174 has been rotated once about axis 124. Further detailed aspects associated with the operation of knob 174, button 194, indicator unit 196, and guide tab 198 are discussed below with reference to FIGS. 5, 6A, 6B, and 6C.

Figure 4:
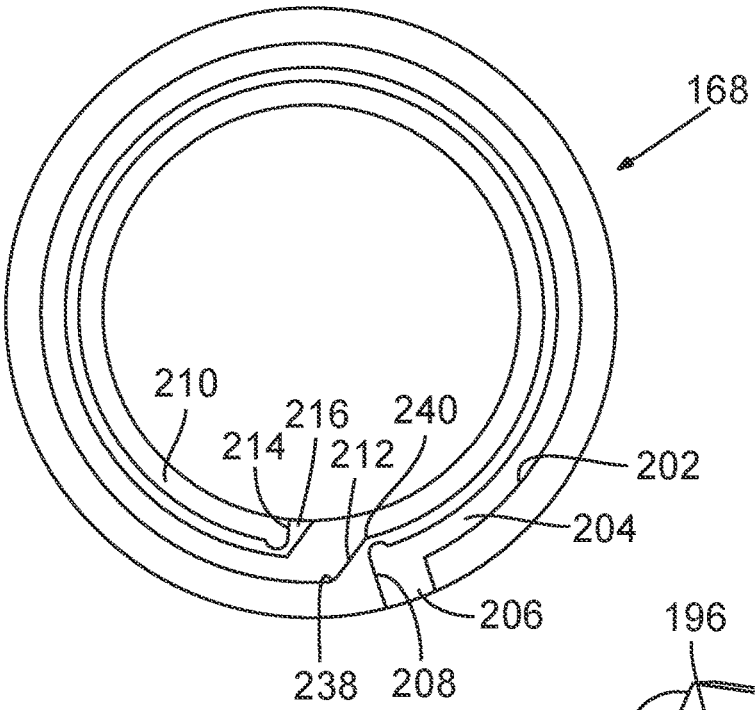
FIG. 4 is a top view of a guide ring of the locking adjustment device of FIG. 1.
Figure 5:
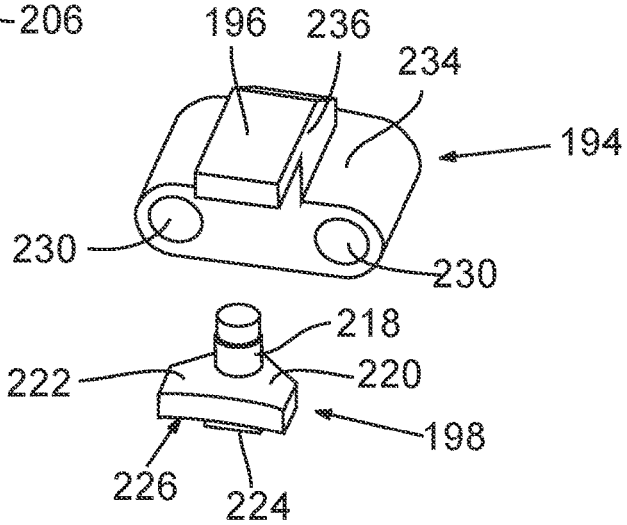
FIG. 5 is an exploded view of the guide ring, a guide tab, and a button of the locking adjustment device of FIG. 1.
Figure 5:
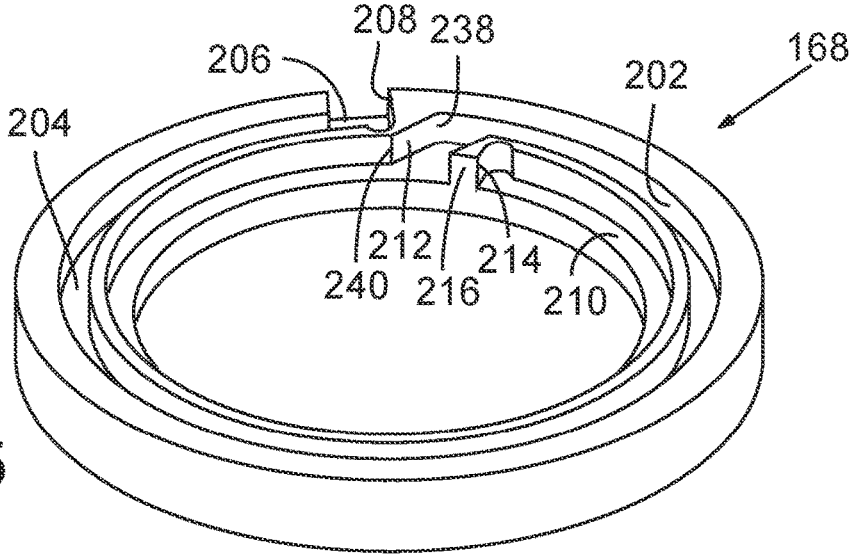

FIG. 4 illustrates a top view of guide ring 168 and FIG. 5 illustrates an exploded view of guide ring 168, button 194, and guide tab 198. With reference to FIGS. 4 and 5, guide ring 168 includes a guideway 202 having a curved slide surface 204 extending around axis 124 (FIG. 2) and a notch 206 formed in a first end 208 of curved slide surface 204 and extending in a radial direction relative to axis 124. Guideway 202 may include a second curved slide surface 210 also extending around axis 124 and linked or connected to curved slide surface 204 via a transition section 212 of guideway 202. In the embodiment illustrated, transition section 212 is in the form of a linear ramp between a second end 238 of first curved slide surface 204 opposite first end 208 and a first end 240 of the second curved slide surface 210. In other embodiments (not shown) transition section 212 may have a different shape. Second curved slide surface 212 includes a second end 214 opposite first end 240. In other embodiments, guideway 202 may form a spiral around axis 124, with curved slide surface 204 disposed at a first radial position from axis 124 and second curved slide surface 210 disposed at a second radial position from axis 124. Second end 214 defines a stop 216 that limits rotation of knob 174 as further described below.

In the embodiments illustrated, curved slide surfaces 204, 210 each face axis 124 (FIG. 2). In other embodiments (not shown), curved slide surfaces 204, 210 might not face axis 124. In some embodiments, curved slide surfaces may include rails, tracks, or other structures that may provide a bearing and guide surface for guide tab 198 or another "follower" device.

It should be understood that in other embodiments, any number of curved slide surfaces may be added to guideway 202, as desired, for allowing a greater or lesser degree of revolution of knob 174, such as three, four or five revolutions. In such embodiments, stop 216 may be defined at an end on the last of the curved slide surfaces opposite first end 208 on guideway 202.

Referring now to FIG. 5, knob 174 carries button 194 and guide tab 198 for rotation therewith, guide tab 198 extending inwardly within knob 174 toward riflescope 138. Guide tab 198 includes a tubular upper portion 218 extending from a top surface 220 of a substantially planar body 222, and a tabbed end 224 extending from an opposing bottom surface 226 of body 222. Guide tab 198, via tabbed end 224, is slidably received by guideway 202 when locking adjustment device 100 is installed on riflescope 138. Guide tab 198 is configured to travel along guideway 202, riding against curved slide surface 204 and second curved slide surface 210 in response to rotation of knob 174.

In some embodiments, guide tab 198 may be rigidly attached or coupled to button 194 via tubular portion 218 of guide tab 198. Tubular portion 218 may be inserted into an opening 228 on button 194 having dimensions corresponding to tubular portion 218 and secured therein, such as by a press fit or using an adhesive. Alternatively, tubular portion 218 and opening 228 may both be threaded so that guide tab 198 is threadably coupled to button 194. In other embodiments, guide tab 198 and button 194 may instead be formed as a single unitary piece.

Button 194 may include a pair of openings 230 sized to interact with a pair of biasing elements 232, such as springs. Biasing elements 232 bias button 194 and guide tab 198 in a radial direction relative to knob 174 so as to urge movement of guide tab 198 when knob 174 is rotated. In some embodiments, button 194 may further include indicator unit 196 arranged on a top surface 234 of button 194. Preferably, indicator unit 196 has an elongate, rectangular-shaped body 236 and is formed as a single, unitary piece of button 194. In other embodiments, indicator unit 196 may have a different shape and may be formed as a separate component of and thereafter attached to button 194. Further details relating to indicator unit 196 are discussed below with reference to FIGS. 6A, 6B and 6C.

The following description illustrates an example operation of the interaction between button 194, guide tab 198, and guideway 202, among other components, of locking adjustment device 100. When locking adjustment device 100 is in a locked position, guide tab 198 is aligned with and seated in notch 206, thereby constraining knob 174 and preventing inadvertent rotation of knob 174 relative to riflescope 138. In this position, biasing elements 232 urge at least a portion of guide tab 198, such as tabbed end 224, into notch 206.

To unlock knob 174, button 194 is depressed inwardly toward axis 124 to urge guide tab 198 out of notch 206 and onto curved slide surface 204 near first end 208. From this position, knob 174 may be manually rotated about axis 124 away from the locked position. As knob 174 is rotated (i.e., as the user is making a desired adjustment), guide tab 198 rides away from first end 208 and along curved slide surface 204. Once knob 174 has completed a rotation around axis 124, guide tab 198 automatically transitions onto ramped transition section 212 and continues on second curved surface 210 to accommodate a second rotation of knob 174. Depending on the shape of transition section 212, the user may or may not feel a minor stop, bump, or other tactile sensation when guide tab 198 transitions between first and second curved surfaces 204 and 210. The user can continue turning knob 174 until guide tab 198 hits stop 216 along second end 214 of second curved surface 210. At that point, stop 216 blocks guide tab 198 from moving beyond second end 214, thereby limiting further rotation of knob 174 in this direction. Knob 174 may still be rotated in an opposite direction for further fine adjustment and/or to return knob 174 to its home position where it automatically locks.

While the figures may illustrate that guideway 202 provides for slightly less than two full rotations about axis 124, a simple alternate design of guideway 202 may accommodate two or more full rotations. For instance, guideway 202 may include a second transition section (similar to the ramped transition section 212) on second end 214 that is linked to a third curved surface extending about axis 124. Stop 216 may be positioned along the third curved surface at a position defining two full rotations of knob 174. In such configuration, once guide tab 198 reaches second end 214, guide tab 198 moves onto the second transition section and continues along the third curved surface until it reaches stop 216. In some embodiments, the third curved slide surface (not shown) may completely extend about axis 124 to provide for an additional rotation of knob 174.

In some embodiments, transition section 212 may instead be a stepped transition section. In such embodiments, button 194 may be further depressible such that it urges guide tab 198 out of notch 206 when button 194 is first depressed and, once knob 174 has made one rotation about axis 124, button 194 may be further depressed to urge guide tab 198 over the stepped transition section and onto second curved slide surface 210. Similarly, button 194 may be retractable, such as using biasing elements 232, so that button 194 automatically retracts when guide tab 198 transitions from second curved slide surface 210, over the stepped transition section, and back onto curved slide surface 204.

Guide ring 168, button 194, and guide tab 198 are preferably constructed of or coated with a rigid, durable, and wear-resistant material, such as nylon, PTFE polymers (e.g., Teflon®), steel, aluminum, or other suitable material, to withstand wear due to friction as guide tab 198 slides along or within guide ring 168. In other embodiments, button 194 may be manufactured from one material and guide tab 198 may be manufactured from a different material. For instance, since button 194 may not experience as much wear due to friction as compared to guide tab 198, button 194 may be constructed from anodized aluminum or other material to provide a balance of component weight, wear-resistance, and strength. On the other hand, since the sliding action of guide tab 198 on or along the guide ring 168 will wear guide tab 198 over time, guide tab 198 may be manufactured from or coated with a different material, such as stainless steel, for strength, wear-resistance, and corrosion-resistance.

Figure 6A:
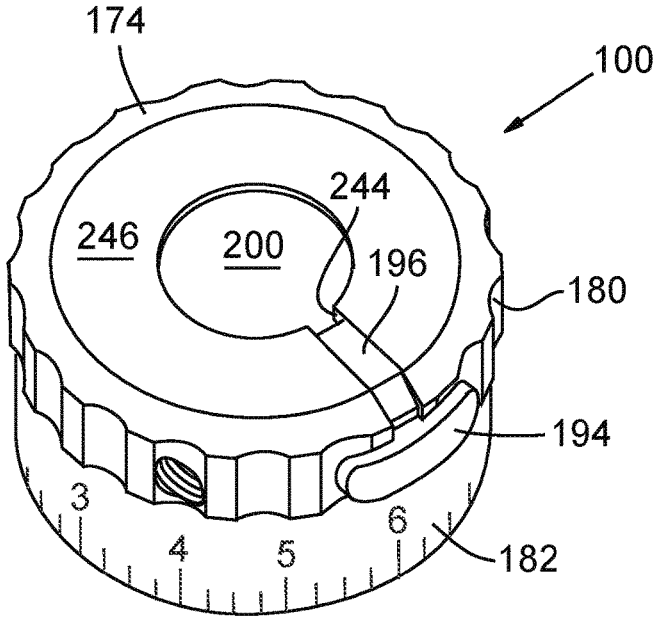
FIG. 6A is a perspective view of the locking adjustment device of FIG. 1 when the locking adjustment device is in a locked position.
Figure 6B:
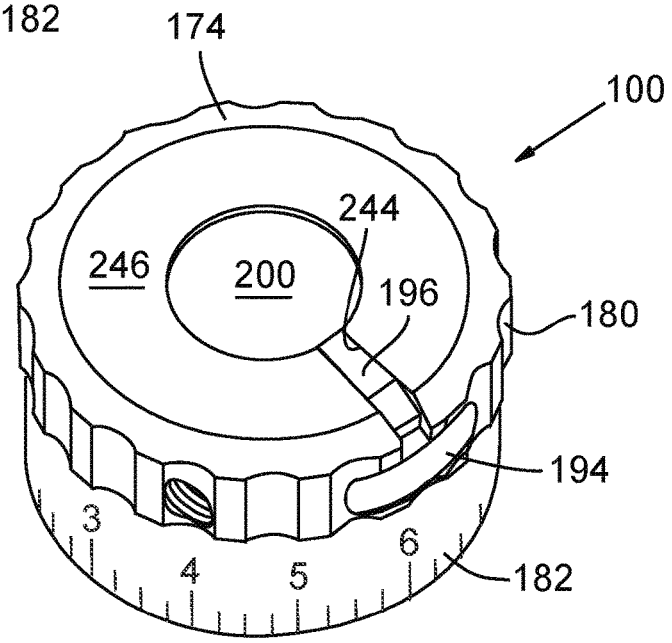
FIG. 6B is a perspective view of the locking adjustment device of FIG. 1 in an unlocked position and in a first rotation about a rotational axis.
Figure 6C:
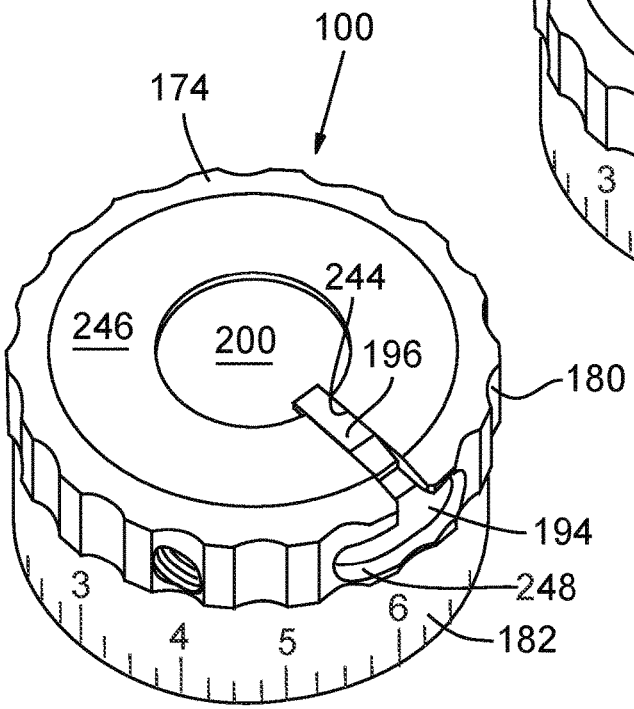
FIG. 6C is a perspective view of the locking adjustment device of FIG. 1 in an unlocked position and in a second rotation about the rotational axis.

FIGS. 6A, 6B, and 6C illustrate example embodiments of knob 174 carrying button 194 with indicator unit 196 for indicating whether knob 174 is in a locked position and also for indicating the number of rotations of knob 174. Simply by considering the relative positions of indicator unit 196 and button 194, the user is able to quickly determine the state of knob 174 (i.e., whether it is locked and/or the number of rotations about axis 124). Knob 174 includes a central recess 200 and a slot 244 extending in a radial direction relative to axis 124. Slot 244 is sized and dimensioned to slidably receive indicator unit 196 such that at least a portion of indicator unit 196 is visible on a top surface 246 of knob 174. Knob 174 further includes an aperture 248 on grip surface 180 sized and dimensioned to slidably receive button 194.

In an example operation, when knob 174 is in a locked position (during which guide tab 198 aligns with notch 206), button 194 and indicator unit 196 may be in a first position, such as illustrated in FIG. 6A. In this first position, button 194 extends outwardly from grip surface 180 and indicator unit 196 is in a retracted state in relation to central recess 200.

To unlock knob 174, the user may depress button 194 inwardly toward knob 174 until it is substantially flush in relation to grip surface 180. Depression of button 194 contracts biasing elements 232 and urges guide tab 198 out of alignment with notch 206 and onto curved slide surface 204, as previously described. Depression of button 194 and guide tab 198 in turn urges indicator unit 196 to move from the first position to a second position, where indicator unit 196 moves toward central recess 200 until it is substantially flush in relation to central recess 200, such as illustrated in FIG. 6B. This second position indicates that knob 174 is unlocked and may be manually rotated about axis 124. As knob 174 is rotated, guide tab 198 slides on first curved slide surface 204 and button 194 and indicator unit 196 remain in this second position while guide tab 198 is on first curved slide surface 204 (i.e., throughout the first rotation of adjustment).

During the second rotation of knob 174, guide tab 198 transitions from curved slide surface 204 to second curved slide surface 210 via transition section 212, as previously described. Since guide tab 198 is coupled to button 194 and indicator unit 196, guide tab 198 draws button 194 inwardly toward axis 124, which simultaneously draws indicator unit 196 into central recess 200 on knob 174. Biasing elements 232 are further contracted in this third position. This third position indicates that knob 174 is unlocked and is in a second rotation about axis 124. As knob 174 is rotated, button 194 and indicator unit 196 remain in this third position while guide tab 198 is on second curved slide surface 210 (i.e., throughout the second rotation of adjustment).

Reversing rotation of knob 174 at any point causes the same functions to be performed in reverse. For example, when knob 174 reverts from the third position to the second position, (i.e., when guide tab 198 transitions from second curved slide surface 210 to first curved slide surface 204), button 194 and indicator unit 196 retract back to their substantially flush positions, as previously described with respect to the second position. Biasing elements 232 also expand to help urge button 194, indicator unit 196, and guide tab 198 back into these second positions. As knob 174 is turned back into its locked position, guide tab 198 is urged into notch 206 by biasing elements 232 to automatically lock knob 174, and button 194 and indicator unit 196 are expanded to their locked positions, where button 194 extends outwardly from gripping surface 180 and indicator tab 196 is in a retracted state from central recess 200.

In some embodiments where locking adjustment device 100 is configured to allow more than two rotations of knob 174, indicator unit 196 can be urged further into central recess 200 and button 194 urged further into aperture 248 in a similar fashion as described above to indicate that knob 174 is in a third rotation about axis 124. In other embodiments, knob 174 may include a scale or other marking near or next to indicator unit 196, such as a number scale with position markings reading 0, 1, and 2, to provide additional visual feedback to the user regarding the position of knob 174. For instance, when knob 174 is in a locked position, indicator unit 196 may be aligned with the 0 marking. When knob 174 is unlocked and in its first or second rotation, indicator unit 196 may align with the 1 or 2 marking, respectively.

In an alternate embodiment, the arrangement of button 194, indicator unit 196, and guide tab 198 may be different. For instance, button 194 may instead be arranged on top surface 246 and moveable in an upward/downward direction relative to riflescope 138 (e.g., along a parallel axis in relation to axis 124). Indicator unit 196 may be arranged along grip surface 180 and coupled to guide tab 198 and button 194 such that it is moveable in a similar fashion as previously described to indicate whether knob 174 is in a locked position and/or the number of rotations of knob 174. In addition, guide tab 198 may be arranged on an end of button 194 and also moveable in an upward/downward direction. In such a configuration, biasing elements 232 may be arranged to instead extend along the upward/downward axis to bias guide tab 198. Button 194, indicator unit 196, and guide tab 198 may be positioned and move between the first, second, and third positions in a similar fashion as previously described.

In addition, curved slide surfaces 204, 210 may be arranged on different planes of guide ring 168 in relation to one another. For instance, curved slide surface 204 may be arranged proximal to knob 174 and second curved slide surface 210 may be arranged proximal to riflescope 138, such that guideway 202 spirals downward toward riflescope 138 from curved slide surface 204 to second curved slide surface 210. Guide ring 168 may include a raised pedestal portion above curved slide surfaces 204, 210 and having a slot or opening sized to receive guide tab 198. When guide tab 198 is positioned in the slot, locking adjustment device 100 is in a locked position (similar to when guide tab 198 was aligned with notch 206). The raised pedestal portion may include a downward sloping ramped portion linking to curved slide surface 204 to provide for movement of guide tab 198 from the raised pedestal portion to guideway 202.

In an example operation, depression of button 194 contracts biasing element 232 and urges guide tab 198 out of the slot in the raised pedestal portion, down the ramped portion, and onto curved slide surface 204. As knob 174 is rotated beyond the first rotation about axis 124, guide tab 198 transitions onto second curved slide surface 210 and draws button 194 inwardly, which simultaneously moves indicator unit 196 along grip surface 180 and further retracts biasing elements 232. Button 194 and indicator unit 196 remain in this position while guide tab 198 is on second curved slide surface 210.

Reversing rotation of knob 174 at any point causes the same functions to be performed in reverse. For instance, when guide tab 198 transitions from second curved slide surface 210 back to first curved slide surface 204, button 194 and indicator unit 196 may retract back to their substantially flush positions and biasing elements 232 expand to help urge button 194, indicator unit 196, and guide tab 198 back into these positions. As knob 174 is turned back into its locked position, guide tab 198 moves up the ramped portion and is urged back into the slot in the raised pedestal portion by biasing elements 232 to automatically lock knob 174. Similar to the previously described embodiments, button 194 and indicator unit 196 then return to their locked positions. Other embodiments and arrangements for button 194, indicator unit 196, and guide tab 198 may be possible.

Figure 7:
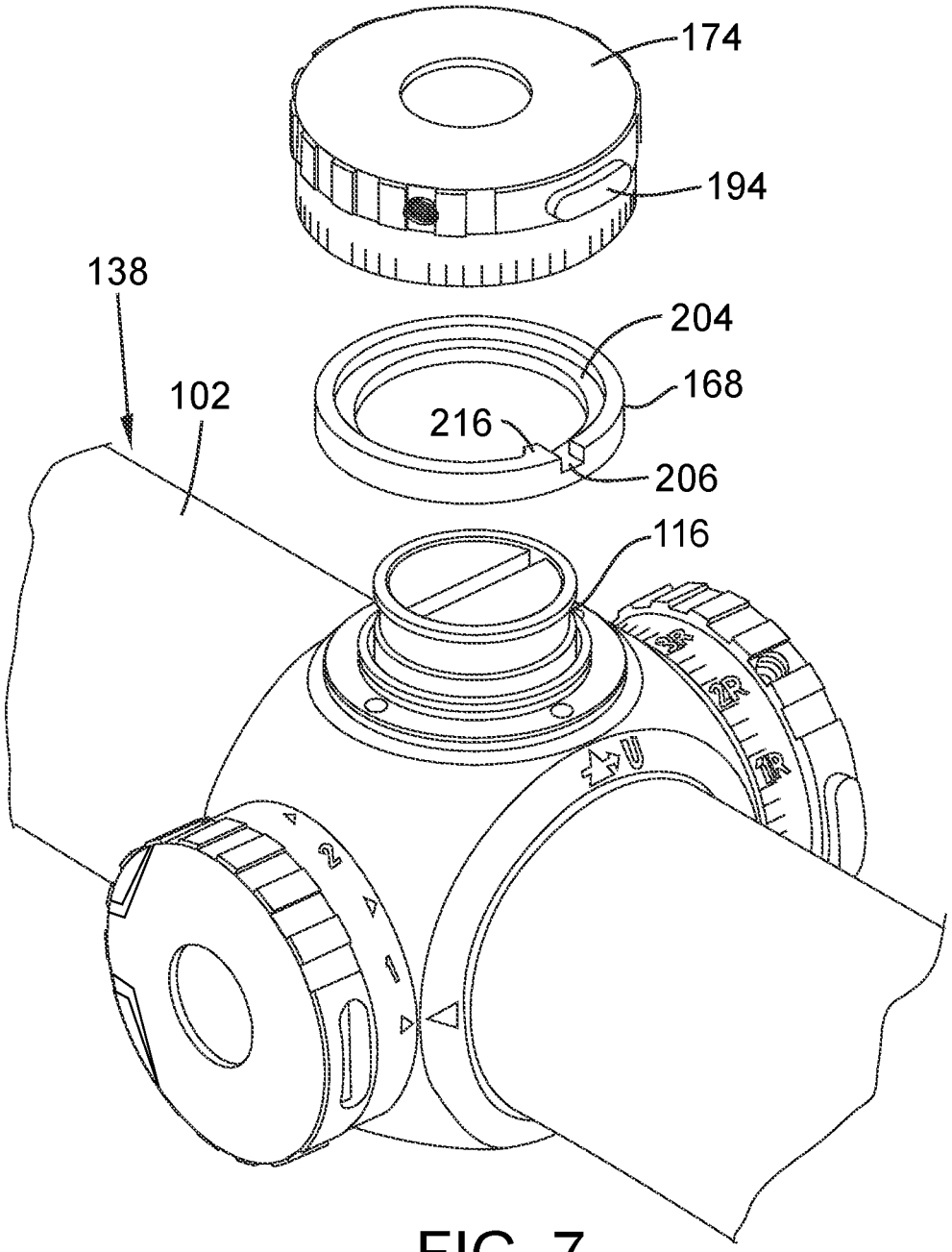
FIG. 7 is an exploded view of a locking adjustment device, according to another embodiment.

FIG. 7 illustrates another embodiment of locking adjustment device 100 where guide ring 168 includes only one curved slide surface 204 to provide for a single rotation of knob 174 about axis 124. Guide ring 168 includes notch 206 and stop 216 both arranged along curved slide surface 204. Guide ring 168 may be attached to spindle 116 in a similar fashion as previously described and knob 174 may include similar components as described in other embodiments, including button 194 operably associated with the guide tab (not shown). In some embodiments, button 194 may not include a separate indicator unit 196. Instead, button 194 may perform a similar indication function.

For instance, when knob 174 is in a locked position, the guide tab is aligned in notch 206 and button 194 is extended outwardly in relation to gripping surface 180 of knob 174.

The extended state of button 194 indicates that knob 174 is in a locked position and cannot be rotated. Depressing button 194 inwardly urges the guide tab out of notch 206 and onto curved slide surface 204 for rotation thereon. Knob 174 may now be manually rotated about axis 124 to make desired adjustments. The depressed state of button 194 indicates to the user that knob 174 is unlocked and may be freely rotated about axis 124. In a similar fashion as previously described, reversing the rotation of knob 174 causes the same functions to be performed in reverse. Knob 174 automatically locks, and button 194 automatically extends from gripping surface 180, when the guide tab is urged back into notch 206.

It will be obvious to those having skill in the art that many changes may be made to the details of the above-described embodiments without departing from the underlying principles of the invention. The scope of the present invention should, therefore, be determined only by the following claims.

The invention claimed is:

1. A sighting device for a weapon or other projectile launcher, the sighting device comprising:

a housing;

an optical element supported by the housing; and a turret assembly mounted to the housing, the turret assembly including:

a knob manually rotatable relative to the housing about a rotational axis to change a setting of the sighting device, the optical element positioned in a first position of a continuous range of positions when the knob is positioned in a stopping position;

a catch defining the stopping position of the knob whereat the catch prevents rotation of the knob in a clockwise or counterclockwise direction; and a lock-release mechanism arranged to disengage the catch in response to a manually-applied force, said disengagement allowing a user to rotate the knob from the stopping position and thereby to continuously move the optical element from the first position to a second non-discrete position of the continuous range of positions;

wherein a graspable portion of the knob includes an opening to expose an actuator that is part of the lock-release mechanism, and wherein the manually-applied force on the lock-release mechanism is applied to said actuator in a radial direction relative to the rotational axis of the knob.

2. The sighting device of claim 1, the catch further including a first portion and a second portion, wherein the second portion is attached to the lock-release mechanism, is rotatable with the knob about the rotational axis, and is rotatable relative to the first portion.

3. The sighting device of claim 2, wherein the first portion and the second portion of the catch cooperate to retain the knob at the stopping position.

4. The sighting device of claim 2, wherein the first portion includes a catch opening or recess formed therein, wherein the second portion includes a catch member seated within the catch opening or recess when the knob is at the stopping position.

5. The sighting device of claim 4, further comprising a biasing element that drives movement of the catch.

6. The sighting device of claim 1, wherein the catch comprises a catch member and the manually-applied force drives movement of the catch member in the radial direction relative to the rotational axis of the knob.

7. The sighting device of claim 1, further comprising a biasing element that biases the lock-release mechanism, wherein at least a portion of the lock-release mechanism protrudes outwardly relative to a surface of the knob when the knob is at the stopping position.

8. The sighting device of claim 1, further comprising an indicator unit carried by the knob and visible on a surface thereof, wherein the indicator unit is at a first position when the knob is in the stopping position and at a second position when the knob is in an adjustment position.

9. The sighting device of claim 8, wherein the indicator unit is movable in a radial direction relative to the rotational axis.

10. The sighting device of claim 1, wherein the catch comprises a catch member, the catch member movable in a radial direction relative to the rotational axis of the knob.

11. The sighting device of claim 1, wherein the knob further includes a scale comprising indicia spaced apart on a circumference of the knob to facilitate fine adjustments.

12. The sighting device of claim 1, wherein the lock-release mechanism is carried by the knob for rotation therewith.

13. The sighting device of claim 12, the knob being rotatable about the rotational axis after removal of the manually-applied force from the lock-release mechanism, to thereby adjust the optical element and change the setting of the sighting device.

14. A scope for a firearm or other ranged device, the scope including the sighting device of claim 1, wherein the optical element is located in a main tube of the scope, wherein the sighting device further comprises:

an elongated body having a first end extending into the housing and a second opposite end located outside the housing, wherein the first end of the elongated body is operably coupled to the optical element, and the second end of the elongated body is operably coupled to the turret assembly.

15. The sighting device of claim 1, wherein at least a portion of the continuous movement of the optical element is performable without simultaneously applying the manually-applied force to the actuator.

16. The sighting device of claim 15, wherein the lock-release mechanism remains in an unlocked state during the at least the portion of the continuous movement.

17. The sighting device of claim 1, wherein the lock-release mechanism has plural states including at least one unlocked state and at least one locked state, wherein:

in a state of the plural states an external surface of the actuator is spaced apart from an exterior surface of the knob by a distance, and in a different state of the plural states the external surface of the actuator is not spaced apart from the exterior surface by said distance.

18. The sighting device of claim 1, wherein, when the catch is disengaged, the knob is rotatable to a clockwise-most terminal position and to a counterclockwise-most terminal position, wherein the knob may not be rotated clockwise past the clockwise-most terminal position, and wherein the knob may not be rotated counterclockwise past the counterclockwise-most terminal position; and wherein, from the clockwise-most terminal position, the knob may be rotated more than one full revolution counterclockwise before reaching the counterclockwise-most terminal position.

19. The sighting device of claim 1, wherein the actuator comprises a depressible button.

20. A sighting device for a weapon or other projectile launcher, the sighting device comprising:

a housing;

an adjustable element supported by the housing; and a turret assembly mounted to the housing, the turret assembly including:

a ring constrained from rotation relative to the housing, the ring including a catch opening or recess;

a knob mounted over the ring and graspable by a user, the knob being manually rotatable relative to the housing about a rotational axis, wherein rotation of the knob about the rotational axis adjusts the adjustable element to change a setting of the sighting device;

a catch member seated within the catch opening or recess when the knob is at a stopping position whereat the knob is prevented from rotating in a clockwise or counterclockwise direction about the rotational axis; and a lock-release mechanism arranged to disengage the catch member from the catch opening or recess in response to a manually-applied force, said disengagement allowing the knob to be rotated from the stopping position, wherein, when the catch member is disengaged, the knob is rotatable to a clockwise-most terminal position and to a counterclockwise-most terminal position, wherein the knob may not be rotated clockwise past the clockwise-most terminal position, and wherein the knob may not be rotated counterclockwise past the counterclockwise-most terminal position; and wherein, from the clockwise-most terminal position, the knob may be rotated more than one full revolution counterclockwise before reaching the counterclockwise-most terminal position.

21. The sighting device of claim 20, wherein the catch member is movable within the catch opening or recess along a radial direction relative to the rotational axis of the knob;

the lock-release mechanism further arranged to drive movement of the the catch member relative to the catch opening or recess.

22. The sighting device of claim 20, further comprising a biasing element that drives movement of the catch member along a radial direction relative to the rotational axis of the knob.

23. The sighting device of claim 20, further comprising a biasing element that biases the lock-release mechanism, wherein at least a portion of the lock-release mechanism protrudes outwardly relative to a surface of the knob when the knob is at the stopping position.

24. A scope for a firearm or other ranged device, the scope including the sighting device of claim 20, wherein the adjustable element is located in a main tube of the scope, wherein the sighting device further comprises:

an elongated body having a first end extending into the housing and a second opposite end located outside the housing, wherein the first end of the elongated body is operably coupled to the adjustable element, and the second end of the elongated body is operably coupled to the turret assembly.

25. The sighting device of claim 20, wherein when the catch member is disengaged, the knob is rotatable without simultaneously applying the manually-applied force to the lock-release mechanism.

26. An apparatus, comprising:

a turret assembly for a sighting device of a weapon or other projectile launcher, the turret assembly including:

a locking adjustment assembly defining a graspable section, the graspable section manually rotatable about a rotational axis, to adjust a setting of the sighting device;

a catch defining a stopping position of the graspable section whereat the catch prevents rotation of the graspable section in a clockwise or counterclockwise direction; and a lock-release mechanism arranged to disengage the catch in response to a manually-applied force in a direction along an axis that is different than the rotational axis, wherein the axes are non-parallel, said disengagement allowing the graspable section to be rotated in the clockwise or counterclockwise direction from the stopping position;

the lock-release mechanism including an actuator, wherein the manually-applied force on the lock-release mechanism is applied to the actuator; and the graspable section of the locking adjustment assembly including an opening to expose the actuator.

27. The apparatus of claim 26, the catch further including a first section and a second section rotatable with the graspable section, wherein the second section rotates relative to the first section.

28. The apparatus of claim 27, wherein one of the first and second sections defines a catch opening or recess, and the other of the first and second sections defines or carries a catch member.

29. The apparatus of claim 27, wherein one of the first and second sections defines a curved slide surface extending around the rotational axis.

30. The apparatus of claim 29, wherein the curved slide surface faces the rotational axis.

31. The apparatus of claim 29, wherein the other of the first and second sections rides against the curved slide surface when the graspable section is rotated from the stopping position.

32. A scope for a firearm or other ranged device, the scope comprising the apparatus of claim 26, the scope including:

a housing; and an elongated body having a first end extending into the housing and a second opposite end located outside the housing, wherein the first end of the elongated body is operably coupled to an adjustable element supported by the housing and the second end of the elongated body is operably coupled to the turret assembly.

33. The apparatus of claim 26, wherein when the catch is disengaged, the locking adjustment assembly is rotatable without simultaneously applying the manually applied force to the actuator.

34. The apparatus of claim 26, wherein the actuator comprises a depressible button.

* * * * *